US005947403A

United States Patent [19]

Johansson et al.

[11] Patent Number: 5,947,403

[45] Date of Patent: Sep. 7, 1999

[54] YARN FEEDING DEVICE

[75] Inventors: Egon Johansson, Asunden; Thomas Bergman; Lars Helge Gottfrid Tholander, both of Ulricehamn, all of Sweden

[73] Assignee: IRO AB, Ulricehamn, Sweden

[21] Appl. No.: 09/011,122

[22] PCT Filed: Jul. 10, 1996

[86] PCT No.: PCT/EP96/03021

§ 371 Date: Apr. 17, 1998

§ 102(e) Date: Apr. 17, 1998

[87] PCT Pub. No.: WO97/03908

PCT Pub. Date: Feb. 6, 1997

[30] Foreign Application Priority Data

Jul. 24, 1995 [DE] Germany ..... 195 26 948
Sep. 8, 1995 [DE] Germany ..... 195 33 310

[51] Int. Cl.[6] ..... B65H 51/00; D03D 47/36

[52] U.S. Cl. ..... 242/364.4; 242/365.4; 139/452

[58] Field of Search ..... 242/364.4, 365.4, 242/365.3, 364; 139/452

[56] References Cited

U.S. PATENT DOCUMENTS 4,429,723 2/1984 Maroino ..... 242/365.4 X
4,926,912 5/1990 Zenoni ..... 242/365.3 X
5,409,043 4/1995 Zenoni et al. ..... 242/365.4 X
5,553,641 9/1996 Zenoni ..... 242/365.4 X
5,778,943 7/1998 Tholander ..... 242/365.4 X

FOREIGN PATENT DOCUMENTS 0 436 900 7/1991 European Pat. Off. .
0 567 045 10/1993 European Pat. Off. .
0 659 918 6/1995 European Pat. Off. .

*Primary Examiner*—Michael Mansen
*Attorney, Agent, or Firm*—Flynn, Thiel, Boutell & Tanis, P.C.

[57] ABSTRACT

A yarn feeding device with a housing, a storage body, an extension arm of said housing, and a holder in the extension arm for an annular yarn braking body which can axially be pressed against the storage body. The holder in said extension arm being slidably guided and being movable between a braking position and a gap position with respect to the storage body. A quick adjustment mechanism which can be manually actuated by means of a handle is provided on or in the extension arm for the holder and allows the holder to be moved in a single stroke from the braking position into the gap position.

20 Claims, 3 Drawing Sheets

YARN FEEDING DEVICE

The present invention relates to a yarn feeding device having a longitudinally movable braking body holder.

BACKGROUND OF THE INVENTION

In a yarn feeding device known from EP 0 567 045 A1, the holder is secured to a slide which is movable along the extension arm. The slide is coupled to an adjusting screw arranged in longitudinally positioned fashion in the extension arm, namely by means of a pin which is seated in the slide at the bottom and which can be lifted by means of an eccentric and a handle to decouple the slide from the adjusting screw. The slide can then be moved by hand on the extension arm into the gap position or removed from the extension arm. In the engaged state of the pin, the slide can also be moved gradually by means of the adjusting screw into the gap position. The gap position is needed to either replace the yarn braking body or the yarn braking element or to thread a new yarn, possibly by hand. The adjustment of the holder by means of the adjusting screw is time-consuming and troublesome. A manual adjustment requires considerable skill for coupling the pin and for adjusting the slide.

In a yarn feeding device known from EP 0 659 918 A1, the holder can be moved by remote control into the gap position by means of a compressed-air cylinder-piston unit. A new yarn is threaded pneumatically by blowing the yarn below the lifted yarn braking element therethrough. Since the piston is acted upon by a restoring spring, there is the risk in case of a manual threading operation or when the yarn braking element or yarn braking body is replaced that the holder will automatically return towards the braking position. Moreover, this is an expensive and troublesome solution which is not suited for a yarn feeding device with manual threading.

SUMMARY OF THE INVENTION

It is the object of the present invention to improve a yarn feeding device of the above-mentioned type in a constructionally simple manner such that the holder can be moved comfortably and rapidly into the gap position and manual threading and/or the replacement of the yarn braking body or the yarn braking element is/are possible without any time limits.

This object is achieved by a yarn feeding device as defined in the appended claims.

The present invention is based on the following concept.

In cases where a new yarn must be threaded by hand or the yarn braking element must be replaced, the operator can bring the holder by means of the quick adjustment mechanism into the gap position in one stroke and thus at a rapid pace, and he can then perform the threading or replacement operation without any time limits. The quick adjustment mechanism may be of a simple constructional type and can be accommodated in a space-saving manner, with the handle of said mechanism being adapted to be positioned at an optimum place to ensure an operation which is as comfortable as possible, even in cases where a plurality of yarn feeding devices including accessories are to be grouped on a textile machine in closely adjacent relationship.

In a convenient embodiment, the gap position can easily be established and eliminated again in one operation. The handle is suitably positioned and arranged such that it does not get in the way in the braking position and is optionally largely hidden, whereas it projects in the gap position in a clearly conspicuous manner and is an indication that the gap position must again be eliminated prior to any further use of the yarn feeding device.

Depending on the configuration of the yarn feeding device, and the arrangement in groups of a plurality of cooperating yarn feeding devices, and also under ergonomic aspects, the mechanism or the handle may be accessible at or on the free end of the extension arm, in the course of the extension arm, or even on the housing of the yarn feeding device. It is even possible to construct the quick adjustment mechanism such that it can be selectively operated from the one or the other position of the feeding device, i.e., to provide more than one handle to ensure optimum operating convenience independently of the arrangement in groups of a plurality of yarn feeding devices and of the operating conditions prevailing on the textile machine.

In another embodiment the holder reliably remains in the gap position after operation of the quick adjustment mechanism and the handle can be released to use both hands for the threading or replacing process.

In another embodiment, the quick adjustment mechanism is integrated in a constructionally simple manner into the predetermined construction of the yarn feeding device.

Depending on the question whether an especially easy-running or long-stroke quick adjustment is desired, the quick adjustment mechanism may include a decreasing or increasing gear mechanism.

Since an adjusting screw usually provided for adjusting the pressing force of the yarn braking element, with the screw extending from the holder to an easily accessible place of the yarn braking device, it is expedient to couple the quick adjustment mechanism with the adjusting screw to move the holder via said screw.

In a constructionally simple and functionally reliable embodiment, upon rotation of the sleeve, the sleeve will perform an axial movement which is transmitted to the adjusting screw and thus to the holder. The guide grove is arranged either in the sleeve or in the extension arm itself.

In another embodiment, a return spring which might be important for the adjustment of the pressing force of the yarn braking element is profitably integrated into the quick adjustment mechanism which than has to ensure movement in one direction only.

In an especially simple embodiment, the quick adjustment mechanism of simple construction uses a pulling element to adjust the holder against the force of the return spring so as to move it into the gap position. In the opposite direction, the return spring performs the adjusting function.

In a further, alternative and simple embodiment, a toothed carrier converts the rotational movement of the adjusting member into the linear movement of the holder. The mechanism is suitably either self-locking or equipped with a lock to maintain the gap position reliably for such a long time as is needed for the threading or replacing operation.

BRIEF DESCRIPTION OF THE DRAWINGS

Embodiments of the subject matter of the present invention will now be explained with reference to the drawing, in which.

DETAILED DESCRIPTION

Figure 1:
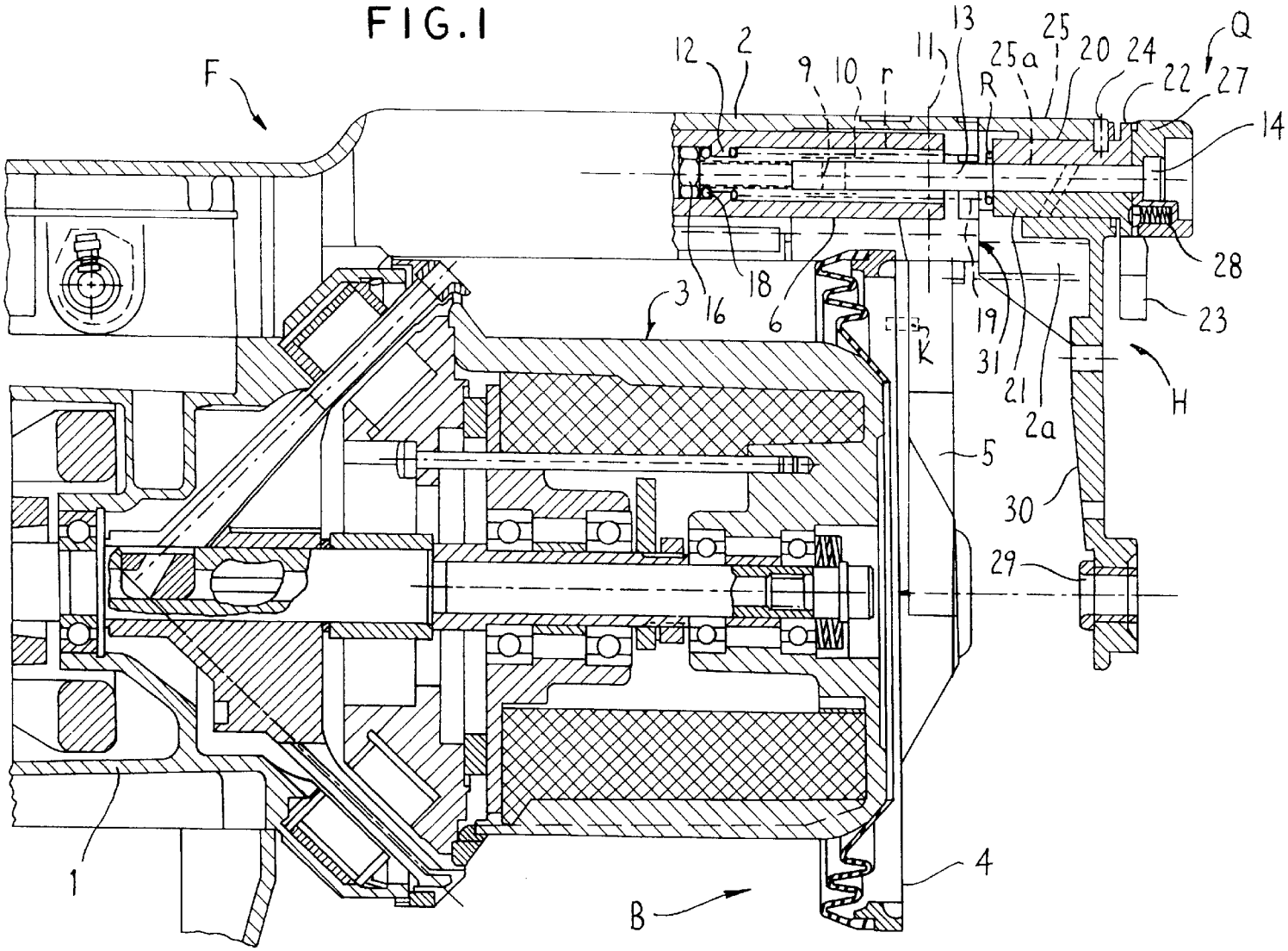
FIG. 1 is a longitudinal section through the yarn feeding device comprising a single-hand quick-adjustment mechanism.
Figure 2:
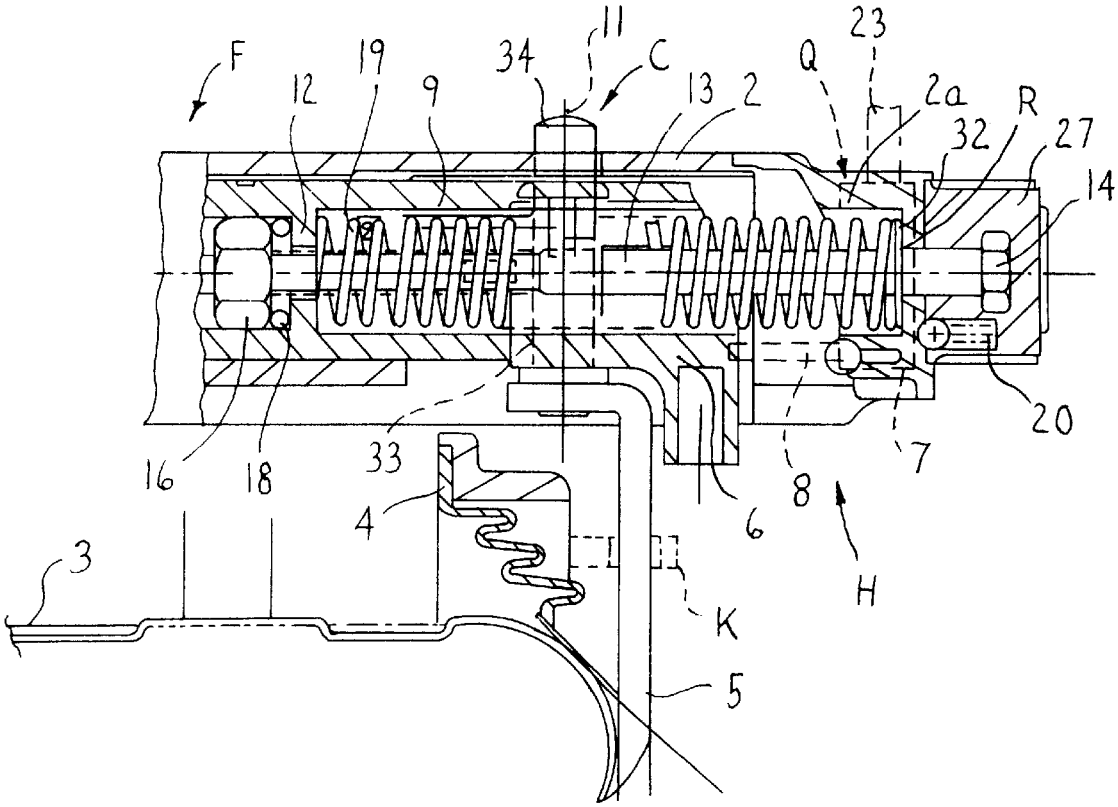
FIG. 2 shows part of a longitudinal section through an alternative embodiment of a yarn feeding device.
Figure 7:
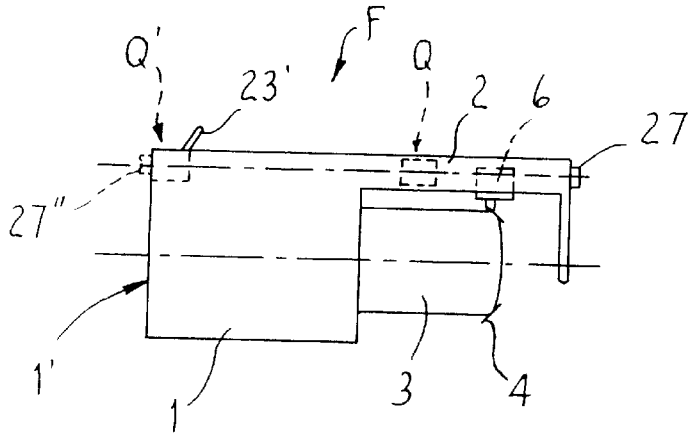
FIG. 7 is a diagrammatic side view of a yarn feeding device, in which several possibilities of accommodating a quick adjustment mechanism are outlined as alternatives or in combined form.

FIGS. 1, 2 and 7 show two embodiments of yarn feeding devices F, with each device comprising an adjustable holding means H for a yarn braking body 4, wherein components which correspond to one another from a functional point of view and which differ from one another in appearance and size are provided with the same reference numerals.

In the yarn feeding device F of FIG. 1, an extension arm 2 is arranged on a housing 1 with an extension end member 2*a* that extends away from the housing 1 along a storage body 3 approximately in parallel with the longitudinal axis of said storage body. The yarn braking body 4 of an annular yarn brake B, which is shown in FIG. 1 in its braking position, cooperates in the customary manner with the storage body 3. The yarn braking body 4 is arranged (in a manner not shown in more detail) on a holder 5 which may have a bifurcated or ring-like shape and is supported in a support body 6. Holder 5 is either fixedly mounted on the support body 6 (FIG. 7) or (FIGS. 1, 2) is on the support body 6 additionally pivotable about an axis 11 which is approximately radial to the storage body 3 (gimbal mounting).

At least one lateral guide nose 9 that engages into a longitudinally extending guide 10 of the extension arm 2 can be provided on the support body 6 which is guided in a longitudinally slidable manner in the extension arm 2.

On its inside, the support body 6 has a transverse wall which forms an axial stop 12. The transverse wall is provided with a hole which is passed through by the threaded section of an adjusting screw 13. An adjusting screw nut 16 which is arranged in a non-rotatable and displaceable manner is screwed onto the adjusting screw 13. An O-ring 18 may be provided between the adjusting screw nut 16 and the axial stop 12. The other side of the axial stop 12 has supported thereon a biased coil spring 19 which passes through the support body 6 and which in the embodiment of FIG. 1 rests with its other end on a sleeve-like adjusting member 21 which rotatably supports the adjusting screw 13. The adjusting member 21 is rotatable within a rotary mount 20 of the extension arm end member 2*a* and projects with an enlarged head member 22 outwards. A handle 23 by which the adjusting sleeve 21 can be rotated is provided on the head member 22. A head 14 of the adjusting screw 13 is held in a turning knob 20 which has a knurled portion and is supported on the head member 22, with a rotary lock 28 being diposed thereinbetween. The adjusting member 21 is part of a quick adjustment mechanism Q for moving the yarn braking body between the respective braking position and a gap position, i.e., respectively, in one stroke and one single-hand operation.

To this end the adjusting member 21 is provided on the outer circumference with at least one inclined, for instance, thread-like guide groove 25 which is engaged by a coupling element 24 that is formed as a pin and is fixedly mounted in the extension arm end member 2*a*. The guide groove 25 is expediently provided with blocking sections 25*a* which extend in the rotational direction and into which the coupling element 24 will respectively enter whenever an axial adjustment of the adjusting sleeve 21 under axial pressure is to be ruled out. The adjusting screw 13 is rotatably supported in the adjusting sleeve 21 and carries a retaining element R, e.g. a securing ring, via which the reaction force of the yarn braking body 4 is transmitted to the adjusting sleeve 21 and from said sleeve to the coupling element 24 and the extension arm 2, 2*a*.

The extension arm end member 2*a* (FIG. 2) has an enlarged wall 30 and a yarn eyelet 29 which is coaxial to the axis of the storage body. The end member 2*a* is secured at 31 to the extension arm 2.

In FIG. 1, the yarn braking body 4 is in the braking position in which it is axially pressed with a predetermined axial force against the storage body 3. This position is either defined by the adjusting screw nut 16 which is intercepted on the axial stop 12, or by the equilibrium of forces existing between the resilient reaction force of the yarn braking body 4 and the force of return spring 19. When in the position of FIG. 1 the axial stop 12 rests on the adjusting screw nut 16, the support body 6 can be adjusted as to its guidance by rotating the adjusting screw 13 by means of the turning knob 27 so as to vary the contact pressure of the yarn braking body.

To move the yarn braking body 4 into a gap position relative to the storage body 3, for instance, in order to thread a yarn with the aid of a threading needle or by hand, or to clean or replace the yarn braking body 4, the turning handle 23 is operated and the adjusting member 21 is rotated by hand, so that the adjusting member 21 is moved to the right side in FIG. 1 thanks to the engagement of the coupling element 24 and carries along the adjusting screw 13 via the turning knob 27, with the adjusting screw 13, in turn, pulling the support body 6 and the yarn braking body 4 into the gap position via the adjusting screw nut 16. It is expedient to rotate the adjusting member 21 to such a degree, suitably through about half a rotation, that the coupling element 24 enters into the blocking section 25*a* at the left side. To return the yarn braking body 4 into the braking position, the turning handle 23 is again operated with one hand in the other direction, and the adjusting member 21 is again brought into the position shown in FIG. 1. The previously adjusted contact pressure of the yarn braking body 4 is not changed.

The embodiment of the yarn feeding device F according to FIG. 2 comprises a holding device H whose support body 6 is also adjustable by means of a quick adjustment mechanism Q between a braking position and a gap position. In the end member 2*a* of the extension arm 2 the adjusting screw 13 is fixed by means of the retaining element R (for instance a Seger ring) in an axially non-movable, but rotatable manner. The turning knob 27 cooperates with an end face of the end member 2*a* which is provided at the right side, and into which locking recesses are molded for the rotary lock 28. Return spring 19 is supported with its end at the right side directly on a counter-surface 32 of end member 2*a*. The holder 5 is pivotable with a pivot pin 33 in the support body 6 about the axis 11.

In addition, there may be provided an intercepting element C for intercepting the support body 6 in the gap position against the action of return spring 19.

As regards the intercepting device C, a manually operable retracting or extending element 34 can be seen that can operate an intercepting element (not shown) which can be retracted against spring load or extended under spring load and which grips behind a stop (not shown) of the support body 6.

The intercepting element C is expediently designed in such a manner that it will become operative by pressing the retracting element 34 as soon as the yarn braking body 4 has reached the gap position. The intercepting element (not shown) will be extended by a renewed movement, either by manually pulling on the holder 5 or by means of the mechanism Q, and the retracting or extending element 34 is again returned into the illustrated position, whereupon return spring 19 returns the support body 6*a*. Mechanism Q is also operated. If, as shown in FIG. 1, the quick adjustment mechanism Q automatically holds the gap position, the intercepting device C can be dispensed with. With respect to a comfortable single-hand operation, preference is given to such a design. The mechanism Q comprises an adjusting member 7 (only illustrated diagrammatically) in the end portion of the extension arm 2, with the adjusting member 7 being connected through a motion-transmitting connection 8 to the support body 6.

In the embodiment of FIG. 1, return spring 19 and the adjusting screw nut 16 can be omitted if the adjusting screw 13 is directly screwed with its threaded section 15 into the transverse wall forming the axial stop 12.

In the yarn feeding device F according to FIG. 2, the adjusting member 7 may be designed in a way similar to that of the adjusting member 21 in FIG. 1. However, it is also possible to configure the mechanism Q in a different manner, for instance in the way outlined in FIGS. 3 to 6.

Figure 3:
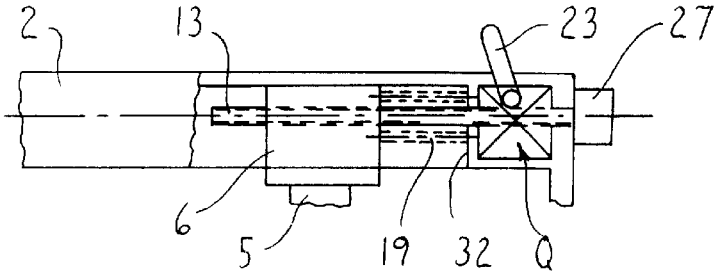
FIG. 3 is a schematic longitudinal section of a further embodiment of the quick-adjustment mechanism.

In the embodiment of FIG. 3, the adjusting screw 13 whose turning knob 27 is accessible at the free end of extension arm 2 acts (in a manner not shown in more detail) on the support body 6 which is guided in the extension arm 2 in a longitudinally displaceable manner. The adjusting screw 13 can here be moved longitudinally together with the support body 6, namely with the aid of the quick adjustment mechanism Q which can be operated by means of the handle designed as the hand lever 23. The adjusting screw 13 can be screwed either into the support body 6 or the mechanism Q. The return spring 19 which presses the support body 6 into the braking position and which is deformed upon operation of the quick adjustment mechanism Q is arranged between the support body 6 and a stop 32 which is fixed onto the extension arm.

Figure 4:
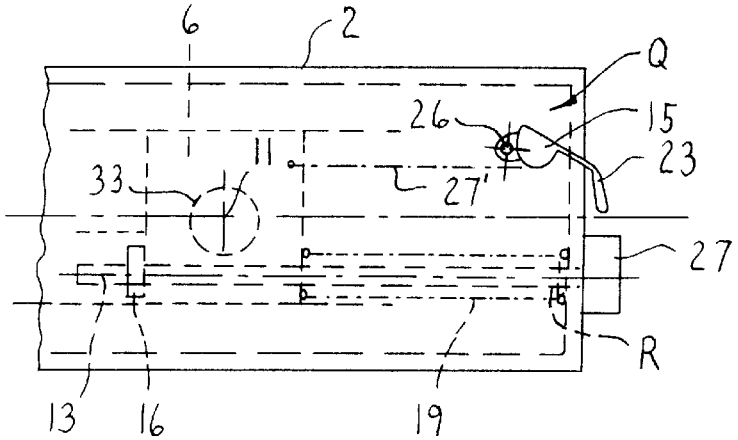
FIG. 4 is a schematic longitudinal section of a further embodiment of the quick-adjustment mechanism.

In the embodiment according to FIG. 4, the quick adjustment mechanism Q is equipped with a tensioning element 15 which in the extension arm 2 is rotatable about an axis 26 located in a direction transverse to the longitudinal axis of the extension arm, and which is connected or engaged via a pulling element 27', such as a rope element or a chain, to the support body 6. The return spring 19 is operatively inserted between the support body 6 and an end wall of the extension arm and is, for instance, passed through by the adjusting screw 13 which is supported by means of the retaining element R in an axially non-movable, but rotatable manner in the extension arm 2. Adjusting screw nut 16 which is non-rotatable relative to the support body 6, but is arranged in an axially displaceable manner, determines the respective position of the support body 6 unless the equilibrium between the pressing force of the yarn braking element (not shown in FIG. 4) and the return spring 19 defines the braking position. The support body 6 is moved via the pulling element 27' into the gap position by pivoting the tensioning element 15 by means of the handle 23. The pulling element 27' is displaced from the position shown in FIG. 4 beyond axis 26 to the other side, resulting in an automatic blocking position in the gap position of the support body. Upon release of the tensioning element 15 the support body 6 is again returned by the return spring 19. The adjusting screw 13 will not follow this adjusting movement, so that the set braking position is maintained in unchanged form.

Figure 5:
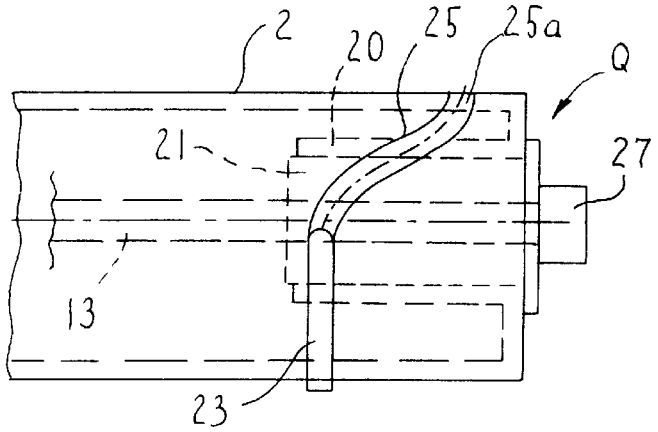
FIG. 5 is a schematic longitudinal section of a further embodiment of the quick-adjustment mechanism.

In the embodiment according to FIG. 5, which is similar to the embodiment of FIG. 1, the adjusting member 21 which is axially adjustable and rotatably supported in the rotary mount 20 of the extension arm 2 is provided with the handle 23 for which the guide grove 25 extending in a direction oblique to the rotary direction of the adjusting member 21 is molded into the extension arm 2, with the adjusting member 21 being axially adjusted with the help of the guide grove 25 upon rotation of the handle 23. The adjusting screw 13 is expediently coupled to the adjusting member 21. The guide grove 25 is provided at least at one end with a blocking section 25*a* in which the handle 23 is blocked against automatic release under an axial force.

Figure 6:
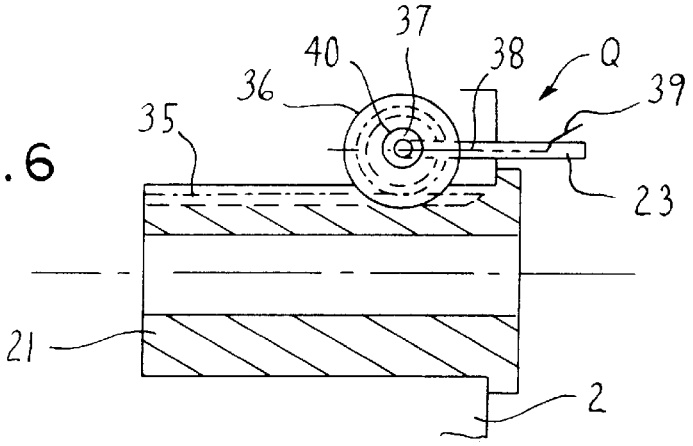
FIG. 6 is a schematic longitudinal section of a further embodiment of the quick-adjustment mechanism.

In the embodiment of FIG. 6, the quick adjustment mechanism Q comprises a toothed carrier 36 which is rotatable about an axis positioned in a direction transverse to the longitudinal direction of the extension arm, for instance, a gear which is rotatable by means of the handle 23 in a rotary bearing 37 fixed onto the extension arm and which engages into a counter-toothing 35, for instance, of the adjusting member 21 of FIG. 1, or (not shown) into a counter-toothing of the adjusting screw. A ratchet 38 which is releasable by means of a key 39 on the handle 23 grips, in the gap position, behind a nose 40 of the bearing 37 to block the support body (not shown) in the gap position. The gap position is adjusted in FIG. 6 by lifting the handle 23 and by rotating the toothed carrier 36 anticlockwise. For resetting purposes the key 39 is pressed anticlockwise to release the ratchet 38 and to rotate the toothed carrier 36 clockwise.

As outlined in FIG. 7, the quick adjustment mechanism Q' is arranged in the yarn feeding device not at the free end of the extension arm 2 (as in FIGS. 1 to 6), but e.g. at the side of the support body 6 which faces away from the free end of the extension arm 2 (not shown), or at the housing 1 of the yarn feeding device as shown, and is suitably accessible from the front side 1' of housing 1. The handle 23' is arranged in the respectively optimum position. The turning knob 27" of the adjusting screw may also be provided such that it then is accessible at the housing front side 1'. The mechanism Q' could also be operable optionally from more than one position on the feeding device F.

In all of the aforementioned embodiments, the handle 23 is expediently arranged and designed in such a manner that in the braking position it does not protrude or is even accommodated such that it is mainly hidden, but distinctly protrudes in the gap position to indicate that the braking position must be set anew before a renewed operation of the yarn feeding device. A single-hand operation is considered to be very well suited.

The various embodiments of the quick adjustment mechanism Q are provided above all for yarn feeding devices in the case of which the yarn is threaded only manually or manually by means of a threading needle, and/or in which a replacement of the yarn braking body or of the yarn braking element may become necessary. This is especially expedient for such yarn braking elements which might suffer from the action of the threading needle because they might be damaged by direct contact and or by the force exerted by the threading needle. These are, in particular, yarn brakes of a modern type with circumferentially uninterrupted yarn braking elements or a yarn braking element consisting of metal or plastic lamellae. Furthermore, the relatively large stroke which is adjustable by the quick adjustment mechanism and is exerted between the braking position and the gap position is expedient for yarn brakes which for replacing purposes require a relatively large space with respect to the storage body 3.

In modern yam brakes, the yarn braking body 4 is most of the time supported on gimbals, so that the yarn braking element can be perfectly centered relative to the storage body. FIG. 1 shows such a support on gimbals through the axis 11 and the support axis which is just shown in the axis as a short black line and which is perpendicular to the axis 11 and provided between holder 5 and yarn braking element 4. The movability of the holder about axis 11 is expediently limited constructionally to a few angular degrees. The movability of the yarn braking element about the axis which is perpendicular to axis 11 can additionally be limited by a ratchet K which optionally permits a movement by a few angular degrees or, in the case of a bristle ring, couples the same virtually fixedly to the holder 5. In FIG. 2, the ratchet K is in detachable engagement with a small motional play relative to the holder 5. However, it is also possible to provide for other motion limiting means for limiting the movements about the two gimbal axes, for instance pivot bearing points or bearing sockets with a limited motional range. Furthermore, in the case of manual threading, the ratchet K has the advantage to prevent unintended tilting of the yarn braking element by which the yarn braking element could be placed into the threading path of the threading needle or the yarn.

We claim:

1. In a yarn feeding device comprising a housing, a storage body on said housing, an extension arm on said housing and a holder which is arranged in the extension arm of said housing, said holder including an annular yarn braking body which comprises at least one yarn braking element which can be pressed axially against said storage body of said yarn feeding device, the holder being movably guided along the extension arm of said housing and being movable between at least one braking position in which said yarn braking element presses on said storage body with an adjustable pressing force and at least one gap position in which said yarn braking element is lifted from said storage body without changing the pressing force, the improvement comprising a holder quick adjustment mechanism provided on or in said extension arm, said quick adjustment mechanism including a handle and being manually operable by means of said handle for moving said holder in one stroke at least from the braking position into the gap position.

2. The yarn feeding device according to claim 1, wherein said quick-adjustment mechanism is operable by a single hand of a user.

3. The yarn feeding device according to claim 1, wherein said handle of said quick adjustment mechanism is arranged at an end of said extension arm which faces away from said housing.

4. The yarn feeding device according to claim 1, wherein said handle of said quick adjustment mechanism is provided in an extension of said extension arm in said housing at a housing front side.

5. The yarn feeding device according to claim 1, wherein said quick adjustment mechanism comprises an automatic holder blocking means for maintaining said gap position.

6. The yarn feeding device according to claim 1, wherein said quick adjustment mechanism comprises an adjusting member which is supported in said extension arm to rotate about an axis oriented in parallel with or in a direction transverse to the longitudinal direction of said extension arm, said adjusting member being acted upon by said handle and being connected in motion-transmitting fashion to said holder in the longitudinal direction of said extension arm.

7. The yarn feeding device according to claim 6, wherein said adjusting member is a sleeve which is rotatable in said extension arm in a rotational direction and is supported in an axially displaceable manner and in which said adjusting screw is held in a rotatable, but axially captured manner, said handle being secured to said sleeve to define a turning handle, either said sleeve in the outer circumference thereof having a guide groove which is inclined relative to the rotational direction for guiding at least one engagement element mounted in said extension arm during rotation of said sleeve, or said extension arm having an inclined guide groove for guiding said turning handle during rotation of said sleeve.

8. The yarn feeding device according to claim 1, wherein a force and/or displacement increasing or decreasing mechanism is provided between said handle and said holder.

9. The yarn feeding device according to claim 1, wherein said quick adjustment mechanism is coupled with an adjusting screw positioned in the longitudinal direction of said extension arm for adjusting the pressing force of said yarn braking element.

10. The yarn feeding device according to claim 9, wherein said adjusting member is a sleeve which is rotatable in said extension arm in a rotational direction and is supported in an axially displaceable manner and in which said adjusting screw is held in a rotatable, but axially captured manner, said handle being secured to said sleeve to define a turning handle, either said sleeve in the outer circumference thereof having a guide groove which is inclined relative to the rotational direction for guiding at least one engagement element mounted in said extension arm during rotation of said sleeve, or said extension arm having an inclined guide groove for guiding said turning handle during rotation of said sleeve.

11. The yarn feeding device according to claim 1, wherein a return spring is arranged between said holder and an abutment fixed onto said extension arm to define a spring force acting therebetween, said holder being movable by means of said quick adjustment mechanism in one direction of movement against the spring force of said restoring spring and in the opposite direction under the spring force of said restoring spring.

12. The yarn feeding device according to claim 11, wherein said quick adjustment mechanism comprises a pulling element which can be tensioned manually by means of a tensioning element, said pulling element being coupled to said holder or to a member connected to said holder counter to said spring force.

13. The yarn feeding device according to claim 1, wherein said quick adjustment mechanism comprises a toothed carrier which is rotatable in said extension arm about an axis positioned in a direction transverse to the longitudinal direction of said extension arm and which engages into a counter-toothing which is connected to said holder such that rotation of said carrier effects movement of said holder.

14. In a yarn feeding device comprising a housing and a storage body supported on said housing for storing yarn thereon, said housing including an extension arm, a yarn braking body which includes a yarn braking element for braking yarn during removal from said storage body, and a holder which is movably supported on said extension arm so as to be movable axially in an axial direction between a braking position and a gap position, said yarn braking body being supported on said holder such that said yarn braking element presses on said storage body with an adjustable pressing force when said holder is in said braking position and is separated from said storage body when said holder is in said gap position, said yarn feeding device further including a force adjustment device which permits adjustment of the pressing force to a set pressing force, said set pressing force being unchanged after said holder is moved from said gap position to said braking position, comprising the improvement wherein said yarn feeding device includes a quick adjustment mechanism which is supported on said housing and is connected to said holder to move said holder axially between said braking position and said gap position, said quick adjustment mechanism comprising a handle which is manually movable between first and second positions and connection means connected between said housing and said holder for moving said holder between said braking and gap positions in response to movement of said handle between said first and second positions respectively.

15. The yarn feeding device according to claim 14, wherein said connection means includes an adjusting member which is connected to said holder and is movable axially relative to said housing in response to movement of said handle between said first and second positions.

16. The yarn feeding device according to claim 15, wherein said handle effects rotational movement of said adjusting member, said connection means comprising a groove which is formed in one of said adjusting member and said housing and a projection fixed to the other of said adjusting member and said housing, said groove being inclined relative to said axial direction and said projection projecting into said groove such that said projection and said groove effect axial movement of said adjusting member as said adjusting member is rotated by said handle.

17. The yarn feeding device according to claim 16, wherein said projection is fixed to said adjusting member and projects outwardly of said housing to define said handle thereon.

18. The yarn feeding device according to claim 15, wherein said handle is pivotally connected to said housing and said connection means comprises an intermediate connector which is connected between said handle and said holder, said intermediate connector being axially movable in response to pivoting movement of said handle between said first and second positions.

19. The yarn feeding device according to claim 18, wherein a gear connection is provided between said handle and said intermediate connector.

20. The yarn feeding device according to claim 14, wherein said force adjustment device includes a biasing member acting on said holder to press said holder against said storage body, said force adjustment device comprising an adjusting part which is movable to adjust a position of said holder relative to said biasing member to adjust said pressing force.

* * * * *